US006526794B1

(12) United States Patent
Langer et al.

(10) Patent No.: US 6,526,794 B1
(45) Date of Patent: Mar. 4, 2003

(54) PLATE FOR THE SPIN DRUM OF A CENTRIFUGE WITH SPACERS AND PROCESS FOR ITS MANUFACTURE

(75) Inventors: Klaus Langer, Sangerhausen (DE); Klaus Pardess, Sangerhausen (DE); Dittmar Holm, Bad Frankenhausen (DE); Albrecht Gruneisen, Artern (DE)

(73) Assignee: Südmo Schleicher AG, Riesburg (DE)

( * ) Notice: Subject to any disclaimer, the term of this patent is extended or adjusted under 35 U.S.C. 154(b) by 153 days.

(21) Appl. No.: 09/589,219

(22) Filed: Jun. 7, 2000

Related U.S. Application Data

(62) Division of application No. 09/060,986, filed on Apr. 15, 1998, now abandoned.

(51) Int. Cl.[7] ..... B21B 27/06

(52) U.S. Cl. ..... 72/69; 72/83; 72/342.94; 72/364

(58) Field of Search ..... 494/68, 70, 71, 494/73, 75, 67; 72/83, 85, 68, 69, 82, 84, 342.1, 342.94, 364; 29/527.2, 557, 527.1

(56) References Cited

U.S. PATENT DOCUMENTS

| | | | | | |
|---|---|---|---|---|---|
| 1,851,527 | A | | 3/1932 | Shee | |
| 3,409,521 | A | | 11/1968 | Sharples | |
| 3,815,395 | A | * | 6/1974 | Sass | 72/69 |
| 4,055,976 | A | * | 11/1977 | Kraft | 72/85 |
| 4,792,317 | A | | 12/1988 | Sipsma | |
| 5,359,872 | A | * | 11/1994 | Nashiki | 72/342.94 |
| 5,384,949 | A | * | 1/1995 | Wodrich et al. | 72/84 |
| 5,687,600 | A | * | 11/1997 | Enigh et al. | 72/69 |
| 5,931,037 | A | * | 8/1999 | Yamada et al. | 72/85 |
| 6,006,569 | A | * | 12/1999 | Shrayer et al. | 72/69 |
| 6,254,256 | B1 | * | 7/2001 | Wolfe | 72/82 |

FOREIGN PATENT DOCUMENTS

| | | | | |
|---|---|---|---|---|
| DE | 142973 | | 3/1902 | |
| DE | 391638 | | 4/1922 | |
| DE | 557376 | | 8/1932 | |
| DE | 1702178 | | 7/1955 | |
| DE | 1243594 | | 12/1967 | |
| DE | 245137 | * | 4/1987 | 72/82 |
| DE | 4036071 | | 11/1991 | |
| EP | 457358 | * | 11/1991 | 72/82 |
| GB | 21381 | | 9/1913 | |
| GB | 266918 | * | 3/1927 | 72/82 |
| JP | 45-39460 | * | 12/1970 | 72/82 |

* cited by examiner

*Primary Examiner*—Ed Tolan
(74) *Attorney, Agent, or Firm*—Collard & Roe, P.C.

(57) ABSTRACT

The invention relates to a plate for a spin drum in a centrifuge. The plates contain integrally formed spacers. These plate spacers are comprised of plate material thickenings and are designed to maintain an intermediate space between two or more plates stacked on top of each other. To create this design, the invention includes a process for the manufacture of the plate as defined above. This process includes the step of roll-pressing a blank over a cone shaped mandrel provided with depressions conforming to the shapes of the spacers of the plate. During this rolling process, the spacers are formed when the depressions in the mandrel are filled with the material of the blank. To ease in the formation of these spacers, the blank may be heated prior to rolling.

3 Claims, 3 Drawing Sheets

PLATE FOR THE SPIN DRUM OF A CENTRIFUGE WITH SPACERS AND PROCESS FOR ITS MANUFACTURE

CROSS REFERENCE TO RELATED APPLICATIONS

This application is a divisional of U.S. patent application Ser. No. 09/060,986 now abandoned filed on Apr. 15, 1998 wherein priority is claimed under 35 U.S.C. § 120.

BACKGROUND OF THE INVENTION

1. Field of the Invention

This invention relates to a plate for a spin drum in a centrifuge. Each plate has spacers which are fixed on the plate and maintain an intermediate space between two or more stacked plates. The invention also includes a process for the manufacture of these plates with spacers.

Generally, centrifuges are formed by a large number of plates stacked one on top of the other in the shape of a truncated cone. These plates are separated from each other by spacers that form intermediate spaces between the plates. In these intermediate spaces, the liquid to be treated is divided in a correspondingly large number of thin layers. The liquid is separated because these liquid components have different densities.

Unfortunately, mounting spacer strips on plates can be very costly. To minimize costs, spot welding has been found to be an economically justifiable process for mounting the spacer strips, and is employed in most cases. However, the spot welding process has one drawback in that fine gaps remain between the surface of the plate and the spacer strips. These gaps cannot be cleaned sufficiently even with intensive circulatory cleaning as is usually applied. Thus, such gaps cause the formation of an undesirable culture medium in which centers of bacteria may develop to contaminate the drum. In products that are expected to meet high hygienic requirements, this bacteria may lead to undesirable contamination of the separated or clarified product. In turn, this contamination may render the product unusable especially in the field of biotechnology.

2. The Prior Art

So as to avoid such contamination, it is known to make the applied spacer strips liquid-tight against the surface of the plate along their longitudinal and cross sides. As described in German Patent DE 557 376 and French Patent FR 464 116, this is accomplished by liquid-tight soldering around the edges of the spacer strips. However, there are two drawbacks to this finishing step. First, the solder is not resistant to aggressive liquids of the type employed in circulation cleaning. Second, additional soldering of the edges of the spacer strips is very expensive.

German Patent No. DE 40 36 071 shows welding of liquid tight spacer strips to the surface of the plate by of a roll welding machine. In addition, German Patent DE 40 36 071 also shows how to weld the spacer strips liquid-tight along their edges with laser welding equipment. It is possible with both welding methods to finish the gaps liquid-tight with welding seams which are resistant to aggressive liquids employed in chemical circulation cleaning. However, these two methods for welding spacers to plates can have many drawbacks.

For example, producing the plates with these welding methods is highly time-consuming and very costly. Furthermore, since there is a large number of spacer strips required for each plate and a large number of plates, this can greatly increase the cost of a centrifuge. These high manufacturing costs may limit the use of these plates to purification processes in a contamination free environment such as in the field of biotechnology.

In addition, roll welding involves substantial deformation of the plate, which may impair the function of the plate. This problem may be so great so as to render the plate unusable. Moreover, when the plates are stacked on top of each other, it is not always possible to ensure that the spacer strips of the individual plates cover each other. These spacer strips may not match with the adjacent plates due to manufacturing tolerances and inaccuracies when the spacer strips are mounted, and the play or clearance required for plugging to the distributor. These spacer strips may be displaced relative to one another to such an extent that individual spacer strips of a plate are supported only on part of the adjoining spacer strip of the adjacent plate. Under certain circumstances, this result may render individual spacer strips ineffective due to the clamping force acting on the plates as the set of plates is being braced, which may lead to undesirable deformation of the surface of the plate. To avoid this result, spacer strips are designed with a width of from 4 to 7 mm. This width range of the spacer strips, which is actually not required for the separation effect, necessarily reduces the surface area available for separation and also clarification of products.

Finally, displacement of the spacer strips may also lead to the formation of micro-gaps between the strips and the adjacent plate surface. Unfortunately, these micro-gaps cannot be closed in spite of the acting clamping pressure. Such micro-gaps, however, may cause contamination of the product treated because such a fine gap structure cannot be engaged or reached in the usual circulation cleaning of centrifuges. Dismantling of the drum for the purpose of thorough manual cleaning is consequently unavoidable when biotechnological products are separated or clarified.

It is known from German Patent DE 17 02 178 Ul to adjust the spacing required between two adjacent plates by embossing from the plate materials. However, this embossing is not capable of counteracting the high pressure by which the plates are pressed together in the centrifuge drum. The consequence thereof is that the stamped structures are forced or pressed back, so that it is not possible to maintain the predetermined spacing between adjacent plates. In addition, there is the risk that displacement is caused within the set of plates, which may lead to strong imbalance of the centrifuge drum.

SUMMARY OF THE INVENTION

Therefore, one object of the present invention is to provide the plate specified above with spacers which can be applied to the plate free of gaps and in a manner that is stable under pressure without additional materials.

In addition, another object of the invention is to provide a centrifuge plate that is simple in design, easy to install, and inexpensive to manufacture.

These objects according to the invention are achieved in that the spacers are material thickenings of the plate itself. Forming the spacers integrally with the plate assures that the spacers are applied to the plate free of gaps. Since the spacers are molded with the plate, the plate consists of a homogeneous material quality. This eliminates the necessity of welding materials.

In addition, forming the plates with the spacers can reduce cracking in the connection seams. Cracking is caused by possible distortions of the plate, which results in a separation of the plate from the spacers at connection seams. Therefore, by forming the spacers to the plates, connection seams are eliminated and cracking is reduced.

Furthermore, the spacer according to the invention adjoins the adjacent plate smoothly and abuts on the surface of the adjacent plate free of gaps after the set of plates has been compressed. As a result of forced material thickening, the intermediate space between the surface of the spacer and the surface of the plate is completely filled and forcing or pressing back of the spacers is prevented. This assures a safe function of the plate without the risk that the spacers may be forced into a position in which the function of the centrifuge drum could be impaired.

According to a preferred embodiment of the invention, the material thickening is shaped on the bottom side of the plate. It is possible to inexpensively manufacture the plate with material thickenings shaped as spacers by roll pressing.

To manufacture the plate inexpensively it should be roll pressed. In addition, with this manufacturing process, the positions of the spacers are distinctly reproducible on each individual plate.

The roll pressing procedure is achieved by pressing the blank across a rolling cone shaped mandrel. The cone forms depressions conforming to the shapes of the spacers of the plate. These depressions are filled with the material of the blank.

This process assures that material thickenings shaped by impression are distinctly reproducible on each individual plate. Since these plates are uniform in design, they stack so that their spacers match with an adjacent plate across their entire surface. There is only minor displacement of adjacent spacers caused by play or clearance required for plugging the plates on the distributor. Therefore, undesirable deformation of the plate within this zone and formation of un-cleanable micro-gaps can be almost completely excluded.

Since the spacers are in an almost uniform position on each plate, it is possible to substantially reduce the width of the spacers and to thereby enlarge the surface area available on each plate for separation or clarification purposes. Moreover, this new procedure removes the additional manufacturing steps such as tacking and liquid-tight welding of the edges of the spacers. Therefore, the manufacturing costs of a plate and thus of a set or pack of plates for a centrifuge drum is significantly reduced.

The side of the depressions directed at the small diameter of the cone-shaped mandrel ends approximately parallel with the center axis of the cone-shaped mandrel. In this way, the pressed plate with the spacers shaped on the bottom side can be easily removed from the cone-shaped mandrel even if spacers with a greater height have to be produced.

In the first stage of the process, the blank is heated prior to roll pressing. However, it may be more advantageous to point or spot heat the roll with a laser beam upstream of the pressing roll. When heat is applied to each blank, it enhances the flow properties of the material on the plate. Since the flow properties are enhanced, this reduces the contact pressure from the cone-shaped mandrel needed to form the spacings. In addition these enhanced flow properties reduce the amount of time that the cone-shaped mandrel needs to form the spacings.

In addition, to facilitate this process, the blank has a thickness that is greater than that required for the final plate. This assures that a pressing bead can develop that is suitable for supplying an adequate amount of material for the spacers. The thickness required for the blank has to be selected prior to roll pressing, and depends on the desired height of the spacers and the wall thickness intended for the finished plate. That way the plate does not have to be reworked.

According to yet another embodiment the process as defined by the invention, a blank which, on the side facing the cone-shaped mandrel, is provided with material accumulations which, during pressing of the plate, are approximately disposed within the zone of the depressions of the cone-shaped mandrel and are pressed into the depressions as material thickenings. The contact pressure of the pressing roller can thus be very favorably selected.

Since the plates are uniformly pre-cast and pre-heated before they are rolled, upon rolling, the spacers are clearly shaped in the same positions in each individual plate produced. Consequently, the surfaces of the spacers of the plates can be shifted or displaced in only a minor way. This minor shifting occurs during clamping of the set of packaged plates on account of the small amount of play required for plugging on the distributor. Such minor displacement, however, will not lead to any formation of micro-gaps that cannot be cleaned, or to any undesirable deformation of the plates. Furthermore, this process dispenses with complicated mounting procedures and liquid-tight welding of the spacer edges extending around a multitude of spacer strips. Both of these processes are very time-consuming and costly, and do not eliminate the risk of inaccurate positioning of the spacer strips.

BRIEF DESCRIPTION OF THE DRAWINGS

Other objects and features of the present invention become apparent from the following detailed description considered in connection with the accompanying drawings which disclose the embodiment of the present invention. It should be understood, however, that the drawings are designed for the purpose of illustration only not as a definition of the limits of the invention.

In the drawings, wherein similar reference characters denote similar elements throughout the several views:

In the drawings,

FIG. 1 is a view of the bottom side of a plate with spacers;

FIG. 2 is a section along lines II—II of FIG. 1.;

FIG. 3 is a cutout III of FIG. 2.;

FIG. 4 is a cutout IV of FIG. 2.;

FIG. 5 is a schematic representation of a device for the plate;

FIG. 6 is a cross-sectional view of the plate wherein the spacing is on the outside of the plate; and FIG. 7 is a view of the bottom side of the plate with non-linear or curved spacings.

DETAILED DESCRIPTION OF PREFERRED EMBODIMENTS

Figure 1:
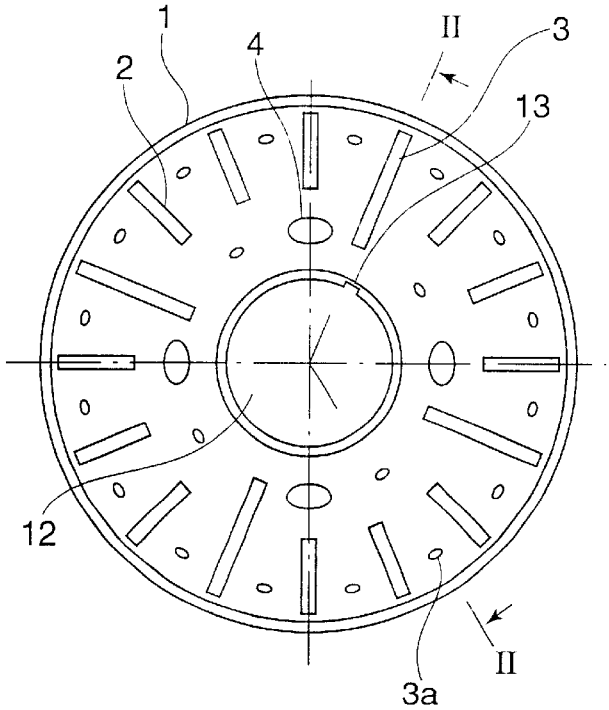
Figure 2:
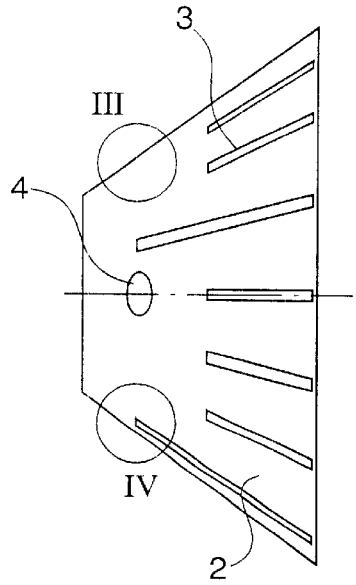

Turning now in detail to the drawings, FIG. 1 shows a plate 1 for a spin drum of the centrifuge, substantially consisting of a thin-walled, truncated cone-like sheet metal body. Plate 1 has a small cover area that is provided with a receiving opening 12 and a locking device 13, and whose large cover area is open. Depending on the application purpose, plate 1 is formed as a truncated cone-like jacket, that is completely closed or is designed with rising holes 4. Located on the outer surface of plate 1 are spacers 3 and 3*a* on inside surface 2.

Figure 3:
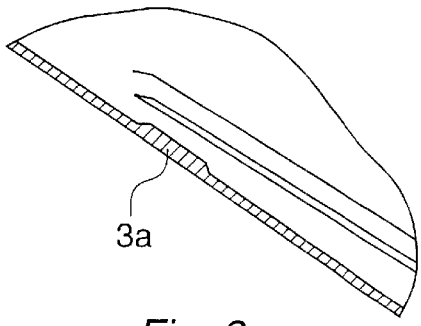
Figure 4:
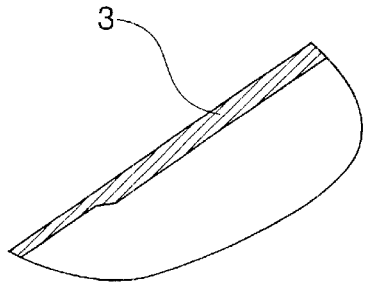

Spacers 3, 3*a* extend uniformly across the circumference of the truncated cone-like jacket. The spacers on plate 1 may be designed in the form of strip-like plateaus as shown by spacers 3 in FIG. 4, or as spacers 3*a* that come in the form of round plateaus as shown in FIG. 3. These spacers are shaped in the form of material thickenings from the material of plate 1 in the course of manufacture. Plate 1 and the spacers 3, 3*a*, consequently consist of an integral material structure.

Figure 5:
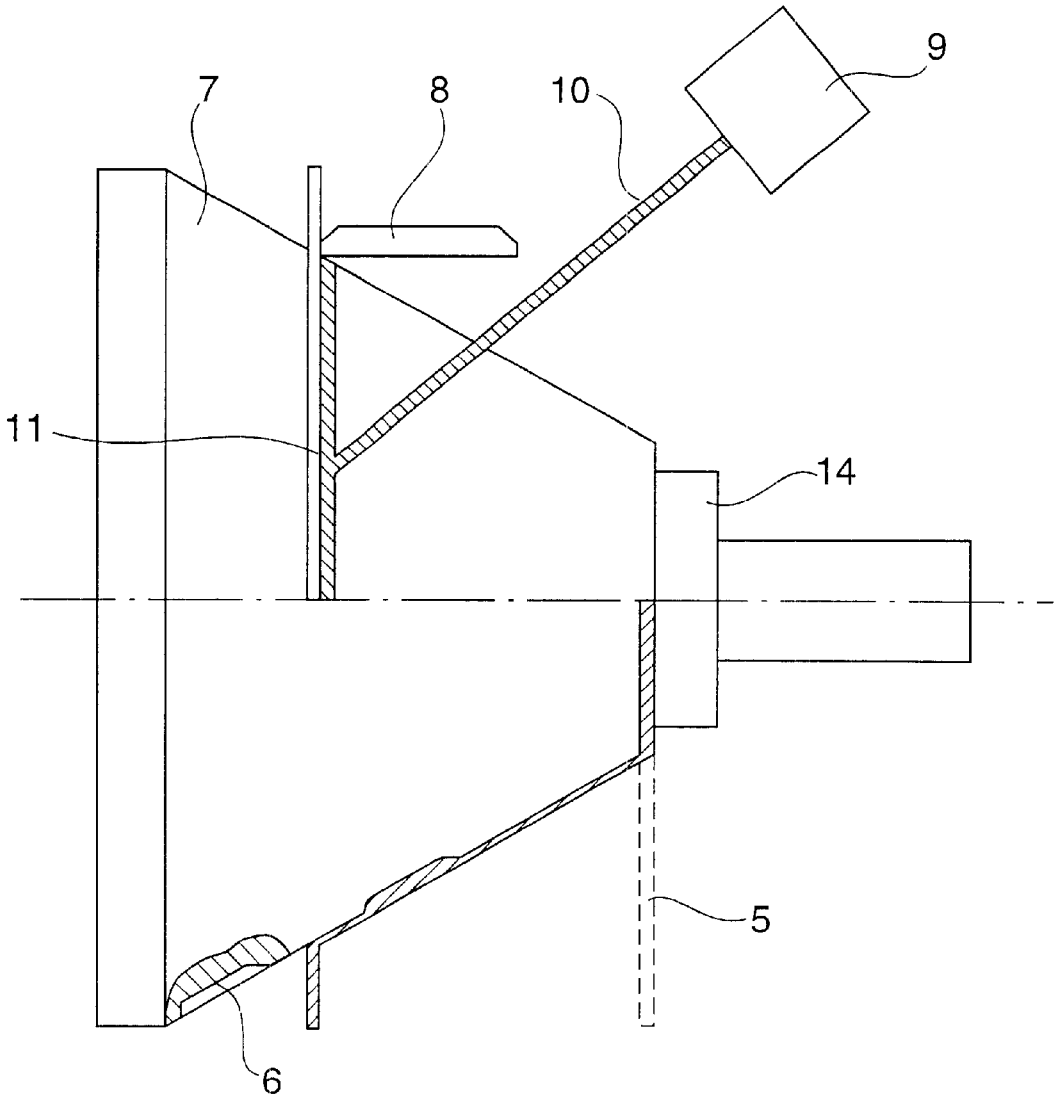

The process for producing plate 1 is carried out on press cone 7 as shown in FIG. 5. For this purpose, blank 5 is wrapped around the outer circumference of cone-shaped mandrel 7. Mandrel 7 has depressions 6 conforming to the shape and position of spacers 3, 3*a* on inside 2 of plate 1. Blank 5, or disk, is chucked with attachment 14 of the pressing machine against cone-shaped mandrel 7 and pressed with press roller 8 across cone-shaped mandrel 7. During operation, excess material from the rolling of plate 5 forms a press bead. The press bead is utilized in such a way that it is molded into depressions 6 in cone-shaped mandrel 7 as blank 5 is being pressed. Plate 1 preferably is pressed in two stages to provide an adequate amount of material for the multitude of spacers 3 and 3*a*. In the first stage, blank 5 is pressed across the entire surface of cone-shaped mandrel 7. Taking into account the supply of material required for shaping spacers 3 and 3*a*, the blank is thicker than the thickness intended for the finished plate 1. In the second stage, the shaped plate 1 is later-drawn on cone-shaped mandrel 7 with depressions 6 by adjusting pressing roller 8 to the material thickness of the finished plate 1. In this way, it is assured that an adequate supply of material is available for shaping spacers 3, 3*a*, and the pressure of press roller 8 can be well-controlled.

To obtain more favorable deformation properties of blank 5, the plate should be heated prior to pressing or molding spacers 3, 3*a*. This heating step is preferably carried out with a laser unit 9. Laser unit 9 sends laser beam 10 to heat a zone which is placed in front of press roller 8. In this way, there is maximum deformability of the press bead developing from blank 5 or the pre-pressed plate 1. However, if possible, this step is achieved in such a way so as to prohibit any change in the structure of the material.

In addition, to allow plate 1 to be removed from cone 7 m without problems, depressions 6 end or terminate in the direction of the small diameter of cone-shaped mandrel 7 approximately parallel with the center axis of said cone.

It is also possible to use a blank 5 which has material accumulations located on one side. When chucked on the pressing machine, the side with material accumulations is directed at the cone-shaped mandrel. The material accumulations on blank 5 are positioned so that they are forced into depressions 6 during the pressing process.

Furthermore, other methods are not excluded for producing plate 1. For example, depending on the material and the requirements of material in terms of casting technology, plate 1 can be manufactured also by the pressure casting process or other methods in the field of casting technology.

Figure 6:
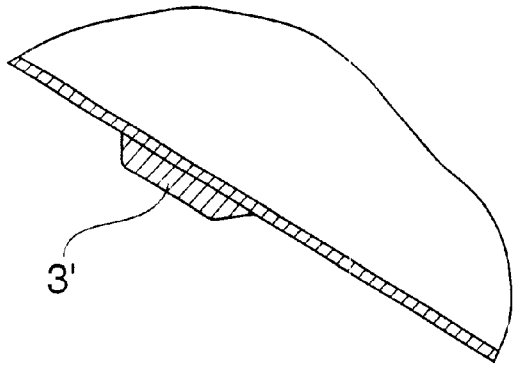
Figure 7:
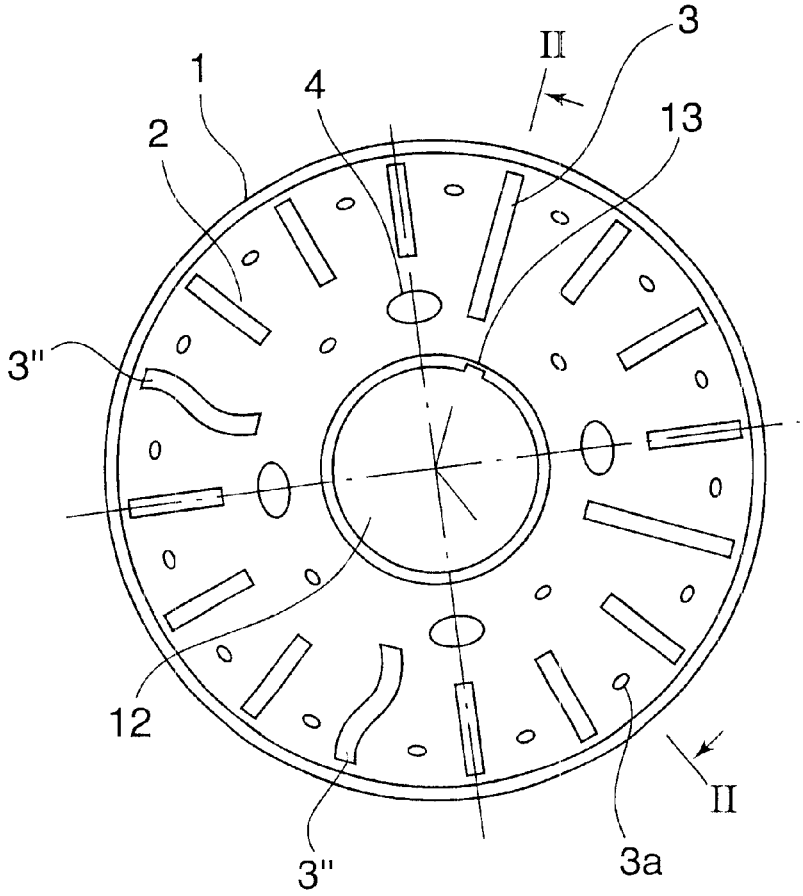

In an alternative embodiment of the invention, as shown in FIG. 6, plate 1 can have spacers 3' that are disposed on an outside surface of plate 1. In addition, as shown in FIG. 7, Spacers 3" can be shaped in a non-linear or curved manner.

While several embodiments of the present invention have been shown and described, it is to be understood that many changes and modifications may be made thereunto without departing from the spirit and scope of the invention as defined in the appended claims.

What is claimed is:

1. A method for producing a dish with spacers for a centrifugal drum of a centrifuge comprising the following steps:

a) heating a plate in a region to be pressed; and b) roller pressing said plate, during said step of heating said plate, on a cone shaped mandrel having molded on deepenings by using a press roller to form shaping spacers on said plate, wherein said plate is heated in a region upstream of said press roller during said roller pressing process so that a region of said plate being pressed has a substantially uniform temperature.

2. The method as in claim 1, wherein said step of heating a plate includes using a laser beam to heat the plate.

3. A method for producing a dish with spacers for a centrifugal drum of a centrifuge comprising the following steps:

a) applying a plate to a cone-shaped mandrel having molded on deepenings;

b) heating said plate in a region to be pressed by using a laser;

c) roller pressing said plate to an initial thickness on said cone shaped mandrel using a press roller;

d) adjusting said press roller to press on a final thickness of said plate; and e) roller pressing said plate to a final thickness to form shaping spacers on said plate, wherein said plate is heated in a region upstream of said press roller during said roller pressing process so that a region of said plate being pressed has a substantially uniform temperature.

* * * * *